United States Patent [19]

Sawahata et al.

[11] Patent Number: 4,884,427

[45] Date of Patent: Dec. 5, 1989

[54] METHOD OF PRODUCING HELICAL INTERNAL GEAR

[75] Inventors: Kazuo Sawahata, Hitachi; Hisanobu Kanamaru, Katsuta, both of Japan

[73] Assignee: Hitachi, Ltd., Tokyo, Japan

[21] Appl. No.: 131,087

[22] Filed: Dec. 10, 1987

[30] Foreign Application Priority Data

Dec. 15, 1986 [JP] Japan ..... 61-296543

[51] Int. Cl.[4] ..... B21D 15/04

[52] U.S. Cl. ..... 72/82; 72/103; 72/111; 72/109

[58] Field of Search ..... 72/102–105, 72/370, 73, 74, 111, 80, 82, 83, 84, 106, 124, 125; 29/508; 10/152 R, 153

[56] References Cited

U.S. PATENT DOCUMENTS

| | | | |
|---|---|---|---|
| 3,087,174 | 4/1963 | Sundholm | 10/152 R |
| 3,089,161 | 5/1963 | Sundholm | 10/152 R |
| 3,130,611 | 4/1964 | Specht | 72/80 |
| 3,263,474 | 8/1966 | Pentland | 72/370 |
| 3,299,680 | 1/1967 | Thompson | 72/82 |
| 3,407,638 | 10/1968 | Greis et al. | 72/105 |
| 3,753,365 | 8/1973 | Kralowetz | 72/76 |
| 4,428,220 | 1/1984 | Rammesten | 72/370 |
| 4,452,060 | 1/1984 | Kanamaru | 72/370 |
| 4,543,813 | 10/1985 | Rogers | 72/356 |

FOREIGN PATENT DOCUMENTS

| | | | |
|---|---|---|---|
| 1075082 | 2/1960 | Fed. Rep. of Germany . | |
| 2107791 | 8/1971 | Fed. Rep. of Germany | 72/105 |
| 2551156 | 5/1977 | Fed. Rep. of Germany . | |
| 26683 | 11/1965 | Japan | 72/104 |
| 73141 | 4/1984 | Japan | 72/412 |
| 229234 | 12/1984 | Japan | 72/412 |
| 727293 | 4/1980 | U.S.S.R. | 72/110 |
| 979001 | 12/1982 | U.S.S.R. | 72/105 |
| 232210 | 10/1986 | U.S.S.R. | 72/105 |
| 960948 | 6/1964 | United Kingdom . | |
| 2066112 | 7/1981 | United Kingdom | 72/104 |

*Primary Examiner*—Robert L. Spruill

*Attorney, Agent, or Firm*—Antonelli, Terry & Wands

[57] ABSTRACT

A method of forming a helical internal gear by cold work, wherein a hollow blank is fitted onto a die on a mandrel, which is provided on an outer periphery thereof with a helical tooth profile and, while the blank is clamped and held in both axial directions thereof, a roller is pressed onto an outer periphery of the blank in a direction perpendicular to an axis of the mandrel while rotating the blank together with the mandrel, whereby the hollow blank is plastically deformed along the helical tooth profile on the die, and then a helical internal gear is formed on an inner peripheral surface of the blank.

1 Claim, 3 Drawing Sheets

METHOD OF PRODUCING HELICAL INTERNAL GEAR

BACKGROUND OF THE INVENTION

The present invention relates to a method of producing a helical internal gear and, more particularly, to a method of producing a helical internal gear by roll forming, which can suitably be carried out in a cold forming operation.

It has been well known to produce a helical internal gear by cutting or by roll-forming using cold forming dies.

For instance, U.S. Pat. No. 4,452,060 discloses a prior method for forming a helical involute spline on an inner surface of a hollow blank, in which a punch provided at an outer surface with a helical involute spline is forcibly inserted and driven into a bore of the hollow blank which is supported at one end thereof by dies.

U.S. Pat. No. 4,452,060 also discloses a method for forming a helical internal gear on a blank, in which a punch provided with a helical tooth is rotated and forcibly driven into the blank using a forward extruding process.

These known methods, however, are still unsatisfactory in that they cannot completely eliminate the necessity for a cutting operation. These methods require a cutting operation for the purpose of forming a stepped entrance to facilitate an introduction of the punch into a bore of the hollow blank. In consequence, the number of steps to be employed is increased and the yield of the material is impaired, with the result that the production cost is greatly raised particularly in a mass-production situation.

Another problem is that, since such gear forming operation is carried out by the forward extruding with the punch of a leading end portion of which is unsupported and free, it is difficult to obtain products having high degree of coaxial precision.

SUMMARY OF THE INVENTION

Accordingly, an object of the present invention is to provide a method of producing a helical internal gear having a high degree of coaxial precision with the reduced number of machining steps.

To this end, according to the present invention, there is provided a method of producing a helical internal gear comprising the steps of: fitting a hollow blank onto a die which is provided on an outer periphery thereof with a helical tooth profile; clamping the blank at both axial ends thereof so as to hold the blank; and pressing a roller radially onto an outer periphery of the blank in a direction perpendicular to an axis of the mandrel while rotating the blank together with the mandrel, whereby an inner surface of the hollow blank is plastically deformed along the helical tooth profile on the die, and is formed with helical teeth.

The object and advantages of the present invention will be more apparent from the following description of the preferred embodiments set forth in connection with the accompanying drawings.

DESCRIPTION OF THE PREFERRED EMBODIMENTS

Figure 1:
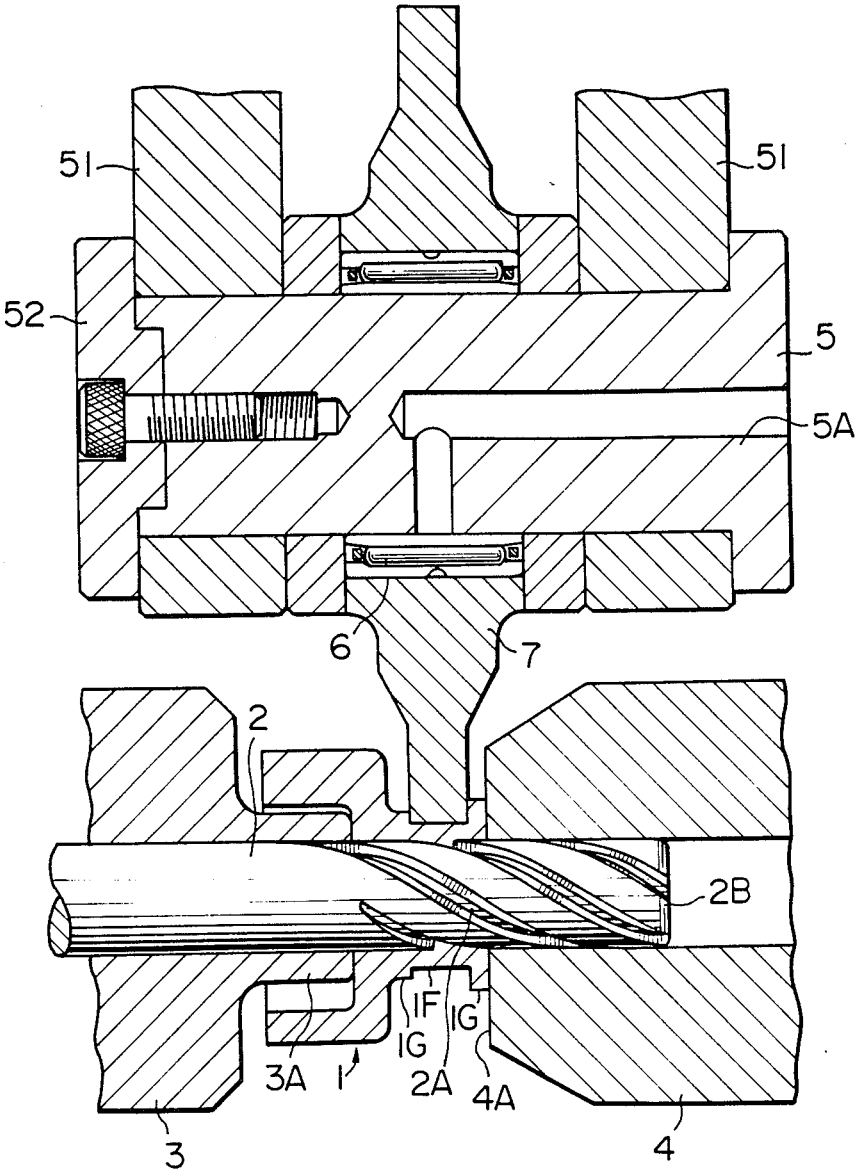
FIG. 1 is a longitudinal sectional view of an apparatus which carries out an embodiment of the method of the invention.
Figure 2:
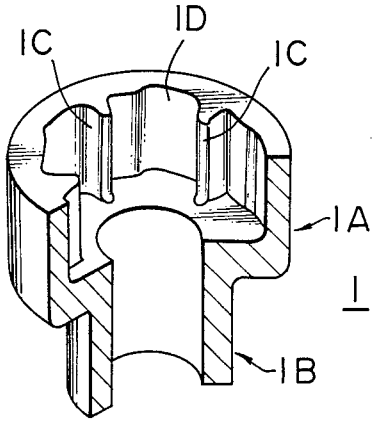
FIG. 2 is a sectional perspective view of a hollow blank of a clutch outer to be produced in accordance with the method of the present invention.

FIG. 1 illustrates a roll forming apparatus for forming an internal helical tooth on a clutch outer of an overrunning clutch of a starter for an automobile. The hollow blank 1 of the clutch outer shown in FIG. 2 is a tubular member made of black-skin steel, which is formed by cold extrusion and constituted by a large-diameter cylindrical portion 1A and a small-diameter cylindrical portion 1B connected to the portion 1A through an annular intermediate portion. A plurality of projections 1C are formed on an inner peripheral surface of the large-diameter cylindrical portion 1A so as to define spaces 1D for a roller. Referring now back to FIG. 1, an operation of forming a helical spline or tooth 1E (FIG. 3) on an inner peripheral surface of the small-diameter cylindrical portion 1B will be described hereinunder.

A mandrel 2 provided at a part 2B of outer periphery thereof with a helical spline (or tooth profile) 2A is inserted into the small diameter cylindrical portion 1B of the hollow blank 1. The mandrel 2 is integrally connected to a spindle 3 which is adapted to be rotationally driven by a suitable prime mover (not shown). The hollow blank 1 on the mandrel 2 is supported at one end of the intermediate portion thereof by a nose portion 3A of the spindle 3, while an end of the hollow blank 1 is abutted against an end surface 4A of the driven shaft 4 having a bore which receives the part 2B of the mandrel 2.

A support shaft 5 is arranged in parallel with the mandrel 2 and is movable close to and apart from the mandrel 2. The support shaft 5 carries a roller 7 through a needle bearing 6. The support shaft 5 is held by arms 51 and a stopper 52 is screw-mounted to one end of the support shaft 5 so as to prevent the roller 7 from coming off the support shaft 5. A numeral 5A denotes a lubricating oil passage through which a lubricating oil is supplied into the bearing 6 so as to lubricate the latter.

Figure 3:
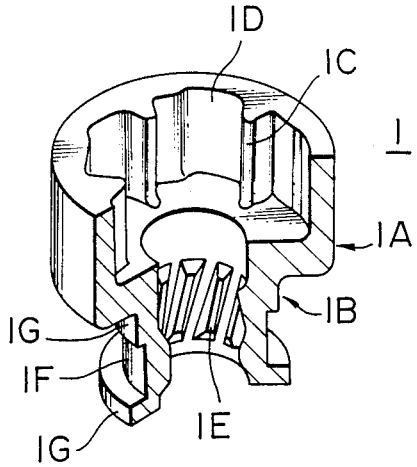
FIG. 3 is a sectional perspective view of the clutch outer produced in accordance with the method of the present invention.

In operation, the spindle 3 is rotated by the primer mover, so that the hollow blank 1 also is rotated. At the same time, the roller 7 is pressed onto the small-diameter cylindrical portion 1B of the hollow blank 1 in a radial inwards, i.e., in a direction perpendicular to an axis of the mandrel 2. In consequence, the small-diameter portion 1B of the blank 1 clamped between the spindle 3 and the driven shaft 4 is plastically deformed along the groove of the helical spline 2A during rotation thereof, which does not restrict such plastic deformation of the blank 1, whereby the helical spline 1E as shown in FIG. 3 is formed on the inner peripheral surface of the small-diameter cylindrical portion 1B of the blank 1. The outer periphery of the small-diameter cylindrical portion 1B is also plastically deformed, so that flange portions 1G is formed by the roller 7 so as to provide an annular groove 1F therebetween. The thus formed clutch outer is then removed from the mandrel 2 by being rotated relative to the mandrel 2. The annular sleeve groove 1F is adapted to be engaged by a shift lever which drives the clutch outer into engagement with a motor pinion when the clutch outer is incorporated in a starter motor.

In the described method, the inner peripheral surface of the small-diameter cylindrical portion 1B fits on the helical splined part 2B of the mandrel 2 so that the blank 1 is held coaxially with the mandrel 2 during forming of the helical spline 1E by cold roll forming. In consequence, a high degree of coaxial precision can be readily attained to meet the design demand. In addition, the helical spline can be formed with a high degree of precision because of the cold rolling, so that the necessity for any subsequent finish processing can be eliminated. Furthermore, the pressing roller also serves as means for forming the sleeve groove in the small-diameter cylindrical portion of the clutch outer, thus making it unnecessary to conduct a milling or other machining operation for the purpose of forming the sleeve groove. In consequence, improvement is achieved both in the yield and the production efficiency.

Figure 4:
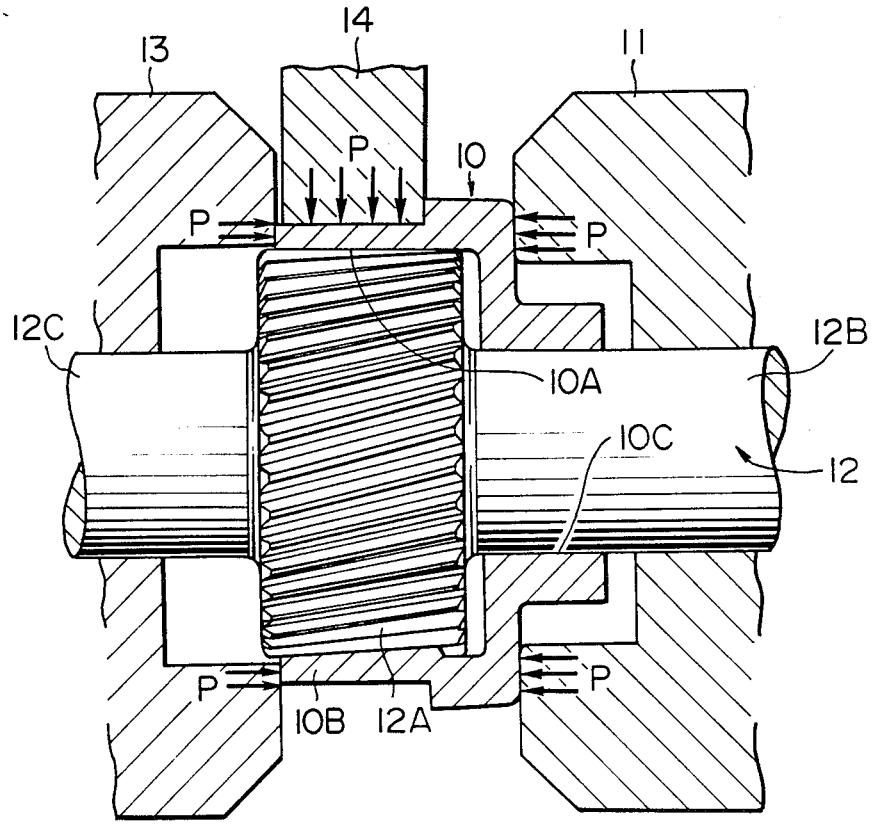
FIG. 4. is a longitudinal sectional view of an apparatus for carrying out another embodiment of the method of the present invention.

FIG. 4 illustrates an apparatus for forming a helical tooth, which carries out another embodiment of the present invention. The apparatus forms a helical tooth 10A on an inner surface of a large-diameter cylindrical portion 10B of a cup-shaped blank 10.

This method employs a die 12A provided at an outer periphery thereof with helical tooth profiles and integrally provided on a mandrel 12. A portion 12B of the mandrel 12 is received in and supported by a bore formed in an driven shaft 11 while a portion 12C of the mandrel 12 is fixed to a drive shaft 13.

An inner surface of a small-diameter cylindrical portion 10C of the blank 10 slides along the surface of the portion 12B in which the driven shaft 11 is removed from the apparatus in advance, so that the blank 10 is fitted onto the die 12A. Subsequently, both axial ends of the large-diameter cylindrical portion 10B are clamped between the drive shaft 13 and the driven shaft 11, whereby the initial setting of the blank is completed.

In operation, the drive shaft 13 is rotatingly driven and a roller 14 is pressed onto an outer peripheral surface of the large-diameter cylindrical portion 10B in a direction perpendicular to an axis of the mandrel 12, so that the large-diameter cylindrical portion 10B is plastically deformed in conformity with a configuration of the helical tooth on the profiles die 12A, whereby the product having an internal helical gear is produced. The product is used, for example, as a reduction gear incorporated in an automative automatic transmission.

According to this method, it is possible to produce a product having a helical internal gear with a high degree of coaxial precision without requiring cutting of the blank material. In the conventional method which employs milling or cutting, it is necessary to provide a margin for allowing the cutting tooth of the tool. In contrast, such a margin is unnecessary in the method of the invention because there is no need for milling or cutting. Thus, according to the described method of the invention, a product having a small axial length can be readily obtained.

It can be possible to produce a product provided at an overall axial length of the inner peripheral surface thereof with a helical internal tooth profile by using an extended die and an extended roller which has an axial length enough to cover the overall axial length of the inner peripheral surface of the product.

It is also to be noted that the helical tooth formed by the method of the present invention is work-hardened by virtue of the use of the roller forming, so that it is not necessary to conduct quench hardening after the formation of the helical gear.

Usually, cup-shaped blanks are provided with bottoms so that they can hardly be machined by, for example, broaching. According to the invention, however, such blanks can easily be machined even by operators who are not so well trained.

As will be understood from the foregoing description, according to the present invention, a hollow cylindrical blank is plastically deformed so as to form an internal helical tooth profile on an inner peripheral surface thereof by roll forming which is performed by pressing a roll onto the blank from the radially outer side of the blank. It is therefore possible to obtain a helical internal gear with a high degree of coaxial precision while reducing the number of steps of the process.

What is claimed is:

1. A method of forming a helical internal gear on an inner peripheral surface of a hollow blank comprising the steps of:

fitting said hollow blank onto a die on a mandrel, which die is provided on an outer periphery thereof with a helical tooth profile;

clamping and holding said blank at opposite axial ends of a portion thereof to be formed; and pressing a roller onto an outer periphery of said blank in a direction prependicular to an axis of said mandrel while rotaring said blank together with said mandrel, whereby said blank is plastically deformed along said helical tooth profile; and wherein said method further comprises the step of forming, simultaneously with the formation of said helical tooth profile on the inner peripheral surface of said blank, a flange on at least one axial end portion of said blank.

* * * * *